US009012837B2

(12) United States Patent
Kou

(10) Patent No.: US 9,012,837 B2
(45) Date of Patent: Apr. 21, 2015

(54) MASS SPECTROMETER AND METHOD OF CONTROLLING SAME

(71) Applicant: JEOL Ltd., Tokyo (JP)

(72) Inventor: Junkei Kou, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 14/085,109

(22) Filed: Nov. 20, 2013

(65) Prior Publication Data

US 2014/0138536 A1 May 22, 2014

(30) Foreign Application Priority Data

Nov. 20, 2012 (JP) ..... 2012-254577

(51) Int. Cl.
*H01J 49/42* (2006.01)
*H01J 49/00* (2006.01)

(52) U.S. Cl.
CPC ..... *H01J 49/4215* (2013.01); *H01J 49/0036* (2013.01); *H01J 49/429* (2013.01)

(58) Field of Classification Search
CPC ..... H01J 49/429
USPC ..... 250/282
See application file for complete search history.

(56) References Cited

U.S. PATENT DOCUMENTS 5,331,403 A * 7/1994 Rosker et al. ..... 356/459
5,420,425 A * 5/1995 Bier et al. ..... 250/292
5,463,219 A * 10/1995 Buckley et al. ..... 250/281
6,153,880 A * 11/2000 Russ et al. ..... 250/292
6,331,702 B1 * 12/2001 Krutchinsky et al. ..... 250/281
6,356,381 B1 * 3/2002 Schade et al. ..... 359/326
6,753,523 B1 * 6/2004 Whitehouse et al. ..... 250/292
6,777,671 B2 * 8/2004 Doroshenko ..... 250/287
7,084,393 B2 * 8/2006 Fuhrer et al. ..... 250/283
7,977,626 B2 * 7/2011 Hidalgo et al. ..... 250/282
8,604,420 B2 * 12/2013 Kou ..... 250/282
2002/0175292 A1 * 11/2002 Whitehouse et al. ..... 250/394
2004/0031918 A1 * 2/2004 Schoen et al. ..... 250/282
2004/0183007 A1 * 9/2004 Belov et al. ..... 250/287
2005/0006577 A1 * 1/2005 Fuhrer et al. ..... 250/287
2005/0023452 A1 * 2/2005 Hashimoto et al. ..... 250/281
2006/0000982 A1 * 1/2006 Keller et al. ..... 250/390.08
2010/0078560 A1 * 4/2010 Basham ..... 250/338.5
2011/0024620 A1 * 2/2011 Hidalgo et al. ..... 250/287
2011/0174967 A1 * 7/2011 Kou ..... 250/287
2011/0220803 A1 * 9/2011 Ohi et al. ..... 250/369

FOREIGN PATENT DOCUMENTS

JP 2010127714 A 6/2010

* cited by examiner

*Primary Examiner* — Phillip A Johnston
*Assistant Examiner* — Sean Luck
(74) *Attorney, Agent, or Firm* — The Webb Law Firm

(57) ABSTRACT

A mass spectrometer and control method which achieves high-speed scanning while maintaining relatively high sensitivity. The mass spectrometer (1) has: an ion source (2); a collisional cell (40) for performing a storing operation for storing at least some of the ions (2) and then performing an ejecting operation for ejecting the stored ions; a second mass analyzer (50) for selecting desired ions; a detector (60) for detecting the desired ions; analog signal processing circuitry (80) for converting a signal from the detector (60) into a voltage; and an A/D converter (90) for sampling and converting the output voltage into a digital signal. Signals delivered from the analog signal processing circuitry (80) in response to two pulsed ions produced by two successive ejecting operations of the collisional cell (40) are at least partially overlapped temporally.

5 Claims, 9 Drawing Sheets

MASS SPECTROMETER AND METHOD OF CONTROLLING SAME

BACKGROUND OF THE INVENTION

1. Field of the Invention

The present invention relates to a mass spectrometer and method of controlling it.

2. Description of Related Art

A quadrupole mass spectrometer is an instrument which has a quadrupole mass filter generating a hyperbolic electric field, produces a selecting voltage by superimposing an RF voltage and a DC voltage on each other, and passes ions of only a desired mass-to-charge ratio by applying the selecting voltage and an axial voltage (that is a DC offset voltage applied to the four quadrupole electrodes equally) to the mass filter. A mass spectrum of the sample is obtained if the mass-to-charge ratio of selected ions is varied in equal increments. This method of measurement for obtaining a mass spectrum is known as scanning. In scanning, the RF voltage and DC voltage applied to the quadrupole mass filter are swept finely.

Sometimes, ion cooling is done on the upstream side of the quadrupole mass filter. In the cooling, ions are normally caused to collide with a gas by a multipole ion guide. The collision with the gas lowers the average kinetic energy of the ions and also reduces the range of kinetic energies. The cooling makes uniform the velocities of ions which are about to enter the quadrupole mass filter. This leads to improvements of resolution and sensitivity.

If two quadrupole mass filters are coupled together and a collisional cell is mounted between them, a triple quadrupole mass spectrometer is built. Since a triple quadrupole mass spectrometer has the two mass analyzers, it provides higher ion selectivity than a single quadrupole mass spectrometer and is often used in quantitative and qualitative analysis.

In a triple quadrupole mass spectrometer, desired ions are first selected by the first mass analyzer. The ions selected by the first mass analyzer are normally known as precursor ions and guided into a collisional cell including a multipole ion guide. An entrance electrode and an exit electrode are disposed at the opposite ends of the ion guide. The ion guide has means for introducing a gas from the outside via a needle valve. If a gas is introduced into the collisional cell, precursor ions collide against the collision gas, producing fragmentation with a certain probability. As a result, the precursor ions are fragmented in the collisional cell. These fragmented ions are known as product ions. Only intended ions of the precursor ions and the product ions in the collisional cell are separated by the second mass analyzer and detected. In a triple quadrupole mass spectrometer, product ions are normally measured and, therefore, the collisional cell is required to have high fragmentation efficiency.

Storage and ejection of ions allow for miniaturization of the instrument. In a quadrupole mass spectrometer or a triple quadrupole mass spectrometer, it is difficult to shorten the quadrupole mass filter because the resolution will be deteriorated by such shortening. To achieve a reduction in instrumental size, it is urged to shorten the multipole ion guide and/or the collisional cell. If these portions are shortened, the number of collisions with the collision gas decreases normally. This will hinder ion cooling or fragmentation. If a large amount of collision gas is introduced to maintain a sufficiently large number of collisions, the pressure in the latter stage of mass analyzer will increase. This may lead to a decrease in sensitivity. However, if a gas is stored temporarily, the ions repeatedly collide with the collision gas while reciprocating between the entrance and exit of the multipole ion guide or collisional cell. Therefore, if the amount of introduced gas is suppressed, a number of collisions necessary for cooling and fragmentation can be secured. As a result, the size of the instrument can be reduced.

In the case of high-speed scanning where the selected ion is varied while one ion is passing through the quadrupole mass filter, it is generally desired to maintain constant the amount of ions entering the quadrupole mass filter in a given time. On the other hand, where ions are stored and ejected, ejection is done intermittently. Therefore, ions entering the quadrupole mass filter assume the form of pulsed ions. If high-speed scanning is done in a quadrupole mass filter into which pulsed ions are passed in this way, there is the possibility that a mass spectrum inaccurately reflecting temporal information about pulsed ions might be observed. For example, no ions enter during the period between two successive pulsed ions. Ions of the mass-to-charge ratio selected during this period have zero intensity. In order to observe a mass spectrum representing intrinsic properties of the sample, the ion selected by the quadrupole mass filter must not be varied while pulsed ions are passing through. As a result, in a triple quadrupole mass spectrometer where ions are stored and ejected, it is difficult to achieve high-speed scanning.

On the other hand, in almost all cases of quadrupole mass spectrometers and triple quadrupole mass spectrometers, a chromatograph is used as a pretreatment unit. In recent years, chromatographs operated at amazingly increased speeds have become available. With this trend, there is an increasing demand for higher-speed scanning of mass spectrometers.

SUMMARY OF THE INVENTION

In view of the foregoing circumstances, the present invention has been made. According to some aspects of the invention, it is possible to offer a mass spectrometer and mass spectrometer control method capable of achieving both a reduction in instrumental size and higher-speed scanning at the same time.

(1) A mass spectrometer associated with the present invention has: an ion source for ionizing a sample; an ion storage-and-ejection portion for performing a storing operation for storing at least some of the ions generated in the ion source and then performing an ejecting operation for ejecting the stored ions; a mass analyzer for selecting desired ions according to mass-to-charge ratio from the ions ejected from the ion storage-and-ejection portion; a detector for detecting the desired ions; analog signal processing circuitry for converting a signal from the detector into a voltage; and an A/D converter for sampling and converting the output voltage from the analog signal processing circuitry into a digital signal. Two signals delivered from the analog signal processing circuitry in response to two pulsed ions produced by two successive ejecting operations of the ion storage-and-ejection portion are at least partially overlapped temporally.

In this mass spectrometer associated with the present invention, a signal indicative of pulsed ions ejected from the ion storage-and-ejection portion can be converted into a DC current before sampling performed by the A/D converter. Consequently, the mass analyzer can perform scanning at high speed.

Furthermore, in this mass spectrometer associated with the present invention, ions are temporarily stored in the ion storage-and-ejection portion prior to entry into the detector. Then, the ions are ejected. As a consequence, relatively high sensitivity can be maintained.

(2) In one feature of this mass spectrometer, the ejecting operations of the ion storage-and-ejection portion have a frequency greater than a frequency bandwidth of the analog signal processing circuitry.

In this mass spectrometer associated with the present invention, the frequency at which ions are ejected by the ion storage-and-ejection portion is made greater than the frequency bandwidth of the analog signal processing circuitry. Consequently, the signal of the pulsed ions can be converted into a DC current. As a result, the mass analyzer can perform scanning at higher speed.

(3) In another feature of this mass spectrometer, at least some of the desired ions contained in the ions ejected by a latter one of the two successive ejecting operations of the ion storage-and-ejection portion may enter the detector earlier than at least some of the desired ions contained in the ions ejected by a former one of the two successive ejecting operations.

(4) In a further feature of this mass spectrometer, there is further provided a control section for controlling timings of storage and ejection of ions performed by the ion storage-and-ejection portion. The control section may cause the storage-and-ejection portion to perform the storing operation and the ejecting operation by applying a voltage to an exit electrode of the ion storage-and-ejection portion. The voltage varies like a rectangular, sinusoidal, or triangular wave.

(5) In a still other feature of this mass spectrometer, there may be further provided a cooling chamber for lowering kinetic energies of the ions generated in the ion source. The cooling chamber may operate as the ion storage-and-ejection portion, perform the storing operation for storing the ions generated in the ion source, and then perform the ejecting operation for ejecting the stored ions. The mass analyzer may select the desired ions according to mass-to-charge ratio from the ions ejected by the cooling chamber.

In this mass spectrometer associated with the present invention, the signal of the pulsed ions ejected from the cooling chamber can be converted into a DC current prior to sampling performed by the A/D converter. Consequently, the mass analyzer can perform scanning at high speed.

Furthermore, in this mass spectrometer associated with the present invention, ions are temporarily stored in the cooling chamber and then ejected prior to impingement on the detector. Consequently, relatively high sensitivity can be maintained.

(6) In a yet other feature of this mass spectrometer, the mass analyzer may include a quadrupole mass filter.

(7) This mass spectrometer associated with the present invention may further include: a first mass analyzer for selecting first desired ions according to mass-to-charge ratio from the ions generated in the ion source; a collisional cell for fragmenting some or all of the first desired ions into product ions; and a second mass analyzer for selecting second desired ions according to mass-to-charge ratio from the first desired ions and the product ions. The collisional cell may operate as the ion storage-and-ejection portion, perform a storing operation for storing the first desired ions and the product ions and then perform an ejecting operation for ejecting the stored ions. The second mass analyzer may operate as the first-mentioned mass analyzer and select the second desired ions according to mass-to-charge ratio from the ions ejected from the collisional cell.

In this mass spectrometer associated with the present invention, the signal of the pulsed ions ejected from the collisional cell can be converted into a DC current prior to sampling performed by the A/D converter. Consequently, the second mass analyzer can perform scanning at high speed.

Further, in this mass spectrometer associated with the present invention, ions are temporarily stored in the collisional cell and then ejected prior to impingement on the detector. Hence, relatively high sensitivity can be maintained.

(8) In a still further feature of this mass spectrometer, there are further provided: a cooling chamber for lowering kinetic energies of the ions generated in the ion source; a first mass analyzer for selecting first desired ions according to mass-to-charge ratio from the ions ejected by the cooling chamber; a collisional cell for fragmenting some or all of the first desired ions into product ions; and a second mass analyzer for selecting second desired ions according to mass-to-charge ratio from the first desired ions and the product ions. The cooling chamber may operate as the ion storage-and-ejection portion and perform a storing operation for storing the ions generated in the ion source and then perform an ejecting operation for ejecting the stored ions. The first mass analyzer may operate as the first-mentioned mass analyzer.

In this mass spectrometer associated with the present invention, the signal of the pulsed ions ejected from the cooling chamber can be converted into a DC current prior to sampling performed by the A/D converter. Consequently, the first mass analyzer can perform scanning at high speed.

Further, in this mass spectrometer associated with the present invention, ions are temporarily stored in the cooling chamber and then ejected prior to impingement on the detector. Hence, relatively high sensitivity can be maintained.

(9) In a yet additional feature of this mass spectrometer associated with the present invention, at least one of the first and second mass analyzers may include a quadrupole mass filter.

(10) A control method associated with the present invention is implemented in a mass spectrometer having: an ion source for ionizing a sample; an ion storage-and-ejection portion for performing a storing operation for storing at least some of the ions generated in the ion source and then performing an ejecting operation for ejecting the stored ions; a mass analyzer for selecting desired ions according to mass-to-charge ratio from the ions ejected from the ion storage-and-ejection portion; a detector for detecting the desired ions; analog signal processing circuitry for converting a signal from the detector into a voltage; and an A/D converter for sampling and converting the output voltage from the analog signal processing circuitry into a digital signal. The control method consists of controlling timings of storage and ejection of ions performed by the ion storage-and-ejection portion in response to two pulsed ions produced by two successive ejecting operations of the ion storage-and-ejection portion such that two signals delivered from the analog signal processing circuitry are at least partially overlapped temporally.

According to this method of controlling a mass spectrometer in accordance with the present invention, the signal of pulsed ions ejected from the ion storage-and-ejection portion can be converted into a DC current prior to sampling performed by the A/D converter. Consequently, the mass analyzer can perform scanning at high speed.

Therefore, according to this method of controlling a mass spectrometer in accordance with the present invention, scanning can be performed at high speed while maintaining relatively high sensitivity.

Furthermore, according to this method of controlling a mass spectrometer in accordance with the present invention, relatively high sensitivity can be maintained by temporarily storing ions in the ion storage-and-ejection portion and then ejecting the ions prior to impingement on the detector.

DESCRIPTION OF THE INVENTION

The preferred embodiments of the present invention are hereinafter described in detail with reference to the drawings. It is to be understood that the embodiments described below do not unduly restrict the scope of the present invention delineated by the appended claims and that the configurations described below are not always essential constituent elements of the invention.

1. First Embodiment (1) Configuration

The configuration of a mass spectrometer according to a first embodiment of the present invention is first described. This spectrometer is a so-called triple quadrupole mass spectrometer and shown in FIG. 1 that is a schematic cross section of the spectrometer, taken in the vertical direction.

Figure 1:
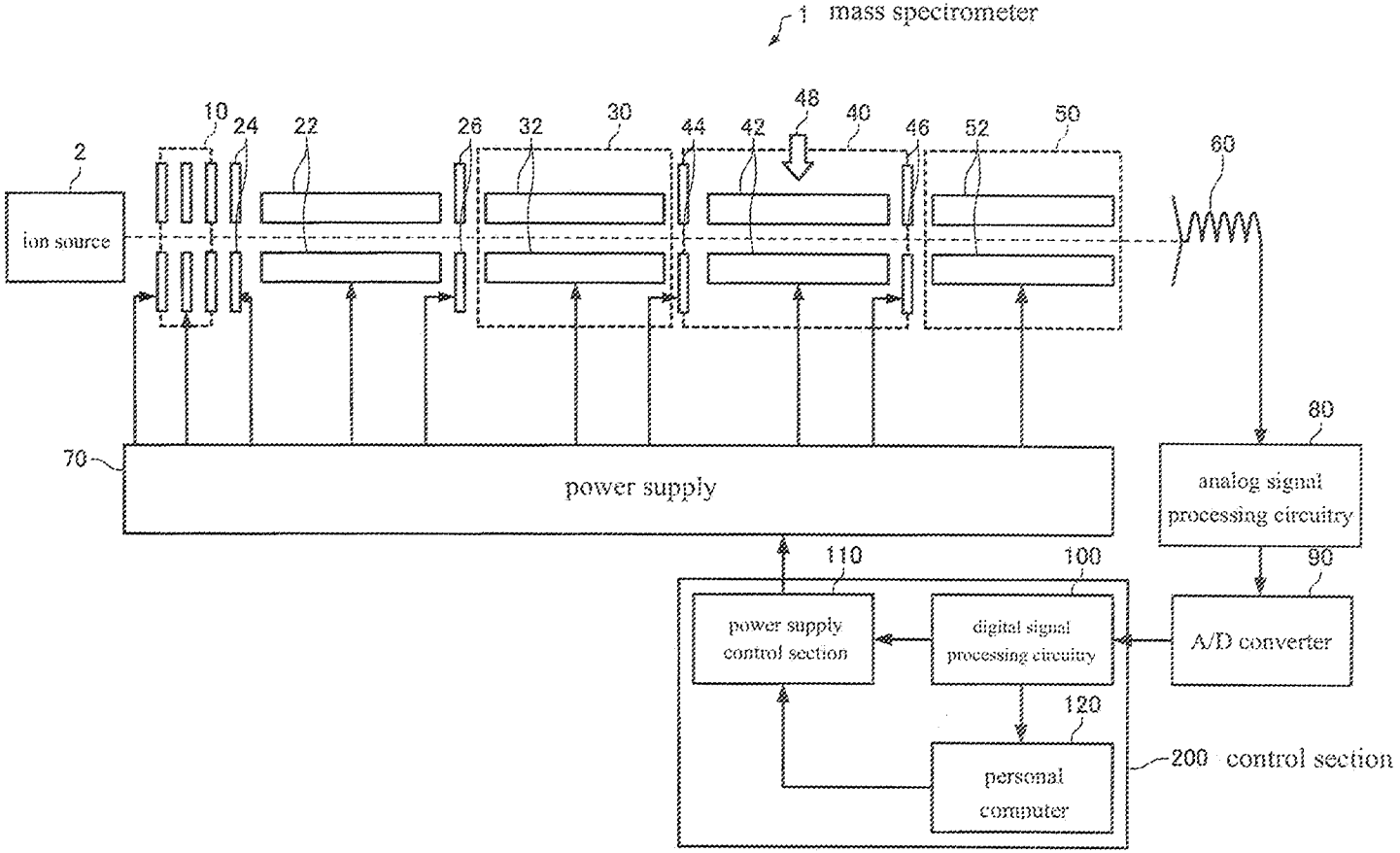
FIG. 1 is a block diagram of a mass spectrometer according to a first embodiment of the present invention.

Referring to FIG. 1, the mass spectrometer according to the first embodiment is generally indicated by reference numeral 1 and configured including an ion source 2, an ion extractor 10, a multiple ion guide 22, a first mass analyzer 30, a collisional cell 40, a second mass analyzer 50, a detector 60, a power supply 70, analog signal processing circuitry 80, an A/D converter 90, digital signal processing circuitry 100, a power supply controller 110, and a personal computer 120. Some of the components of the mass spectrometer shown in FIG. 1 may be omitted.

The ion source 2 ionizes a sample introduced from a sample inlet apparatus (not shown) such as a chromatograph by a given method. The ion source 2 can be a continuous atmospheric pressure ion source for continuously generating ions by an atmospheric pressure ionization method (such as an ESI) or an ion source utilizing an ionization method implemented in a vacuum such as an electron impact ionization method.

The ion extractor 10 consists of one or more electrodes, each centrally provided with an opening, and is mounted behind the ion source 2. The ions generated by the ion source 2 pass through the ion extractor 10, enter the multipole ion guide 22 from an entrance electrode 24, and are introduced into the first mass analyzer 30 from an exit electrode 26.

The first mass analyzer 30 selects first desired ions from the ions generated in the ion source 2 according to mass-to-charge ratio m/z (the mass m of each ion divided by the valence number z). In particular, the first mass analyzer 30 is configured including a quadrupole mass filter 32. The first mass analyzer 30 selects and passes only ions having a mass-to-charge ratio corresponding to a selecting voltage applied to the mass filter 32. The selecting voltage is obtained by superimposing an RF voltage and a DC voltage on each other. The ions selected by the first mass analyzer 30 are known as precursor ions.

The collisional cell 40 is mounted behind the first mass analyzer 30. The precursor ions selected by the first mass analyzer 30 are guided into the collisional cell 40. The collisional cell 40 includes a multipole ion guide 42, as well as an entrance electrode 44 and an exit electrode 46 disposed at the opposite ends of the ion guide 42. Furthermore, the cell includes a gas inlet means 48 (such as a needle valve) for introducing a gas such as helium or argon from the outside. Each of the entrance electrode 44 and exit electrode 46 is centrally provided with an opening. By introducing a gas into the collisional cell 40, some or all of the precursor ions collide with the gas and become fragmented with a certain probability provided that the collisional energy is equal to or higher than the dissociation energy of the precursor ions. The dissociation energy is substantially equal to the difference in positional energy caused by the potential difference between the axial voltage on the multipole ion guide 22 and the axial voltage on the multipole ion guide 42. Ions fragmented in the collisional cell 40 are known as product ions.

The second mass analyzer 50 is mounted behind the collisional cell 40. Precursor ions and product ions inside the collisional cell 40 pass through the exit electrode 46 and enter the second mass analyzer 50, which selects second desired ions from the precursor ions and product ions according to mass-to-charge ratio (m/z). In particular, the second mass analyzer 50 is configured including a quadrupole mass filter 52. The second mass analyzer 50 selects and passes ions with a mass-to-charge ratio corresponding to the selecting voltage (superimposition of the RF voltage and DC voltage) applied to the quadrupole mass filter 52.

The detector 60 is mounted behind the second mass analyzer 50 such that the ions selected by the second mass analyzer 50 are detected by the detector 60. In particular, the detector 60 produces an output current proportional to the number of incident ions.

The output current from the detector 60 is converted into a voltage by the analog signal processing circuitry 80. Furthermore, the processing circuitry 80 may remove undesired noises by a filter.

The output signal from the analog signal processing circuitry 80 is sampled by the A/D converter 90 and converted into a digital signal.

This digital signal is accumulated a given number of times by the digital signal processing circuitry 100. The results are routed to the personal computer 120, which in turn stores the results in an ancillary storage device (not shown) and displays the results.

All the voltages applied to the ion source 2, ion extractor 10, multipole ion guide 22, first mass analyzer 30, collisional cell 40, and second mass analyzer 50 are supplied from the power supply 70, which is under control of the power supply controller 110. Especially, in the present embodiment, the power supply controller 110 controls the power supply 70 such that the collisional cell 40 performs a storing operation for a given storage time to store precursor ions and product ions and then performs an ejecting operation for a given opening time to eject the stored ions.

In the present embodiment, the digital signal processing circuitry 100, power supply controller 110, and personal computer 120 together constitute a control section 200. This control section 200 sets the periods of storing and ejecting operations of the collisional cell 40 (i.e., the frequency at which the exit electrode 46 is opened and closed) based on information about settings.

The multipole ion guide 22 is not essential for the mass spectrometer 1 of the present embodiment. However, where an atmospheric pressure ion source is used as the ion source 2, the multipole ion guide 22 is preferably mounted. Generally speaking, where an atmospheric pressure ion source is used, ions which have just exited the ion extractor 10 have high kinetic energies. Under this condition, the resolution and sensitivity of the first mass analyzer 30 would deteriorate. Therefore, the multipole ion guide 22 is mounted and cooling is done. Since a large amount of air from the atmospheric pressure ion source flows into the multipole ion guide 22 through the entrance electrode 24, the ions collide with the residual gas and thus their kinetic energies are reduced. As a result, the total energy of ions just passed through the exit electrode 26 is substantially equal to the positional energy created by the axial voltage on the multipole ion guide 22. Furthermore, the width of the kinetic energies is homogenized to a level that is equivalent to the temperature (room temperature) of the residual gas.

(2) Operation

The operation of the mass spectrometer 1 according to the first embodiment is next described. In the following description, it is assumed that ions generated in the ion source 2 are positive ions. They may also be negative ions. An explanation similar to the explanation provided below can be applied to negative ions if the voltages are reversed in polarity.

The ions generated in the ion source 2 pass through the multipole ion guide 22 and enter the first mass analyzer 30. The precursor ions selected by the first mass analyzer 30 enter the collisional cell 40.

After ions are once stored in the collisional cell 40, the ions are ejected from it. To permit ions to be stored and ejected, a pulsed voltage is applied to the exit electrode 46 from the power supply 70. If the pulsed voltage is made higher than the axial voltage on the multipole ion guide 42, the exit electrode 46 is closed. The ions are stored in the collisional cell 40.

On the other hand, if the pulsed voltage is made lower than the axial voltage on the multipole ion guide 42, the exit electrode 46 is opened, permitting ejection of ions. A collision gas such as a rare gas is introduced into the collisional cell 40 by the gas inlet means 48. The collision gas has the effect of lowering the kinetic energies of the ions in the collisional cell 40 by collision, in addition to the effect of promoting generation of product ions by fragmenting precursor ions. Therefore, ions returning to the entrance electrode 44 during storage after being bounced back by the potential barrier of the exit electrode 46 have energies lower than energies possessed by the ions which first passed through the entrance electrode 44. If the voltage on the entrance electrode 44 is adjusted, ions from the upstream side can be made to pass, while ions returning from the downstream side can be prevented from passing. Consequently, the storage efficiency of the collisional cell 40 can be made high.

Storage and ejection of ions by the collisional cell 40 allow for miniaturization of the mass spectrometer 1. In the mass spectrometer 1 that is a triple quadrupole mass spectrometer, if the first mass analyzer 30 and the second mass analyzer 50 were shortened, the resolution would be deteriorated and so it is difficult to shorten them. To achieve miniaturization, it is urged to shorten the multipole ion guide 22 and the collisional cell 40. If these portions are shortened, the number of collisions with the collision gas will normally decrease. This will hinder ion cooling and fragmentation. If a large amount of collision gas is introduced to maintain a sufficiently large number of collisions, the pressure inside the later stage of mass analyzer will increase, leading to sensitivity deterioration. However, if ions are temporarily stored in the collisional cell 40, the ions repeatedly collide with the collision gas while reciprocating between the entrance and the exit of the collisional cell 40. Therefore, if the amount of introduced gas is suppressed, a number of collisions necessary for fragmentation can be secured. As a result, the size of the instrument can be reduced.

In the present embodiment, pulsed ions ejected from the collisional cell 40 pass through the second mass analyzer 50 but produced individual pulsed ions are not completely isolated from each other temporally. Two pulsed ions produced by two successive ejecting operations are at least partially overlapped temporally and pass through the second mass analyzer 50. Such temporal smoothing of the pulsed ions permits high-speed scanning at the second mass analyzer 50.

The smoothing is achieved, for example, by reducing the interval at which the exit electrode 46 is opened and closed. This reduces the interval at which ions are ejected. Under this condition, variations in ion speed prevent pulsed ions from being completely separated from each other temporally in the second mass analyzer 50.

Figure 2:
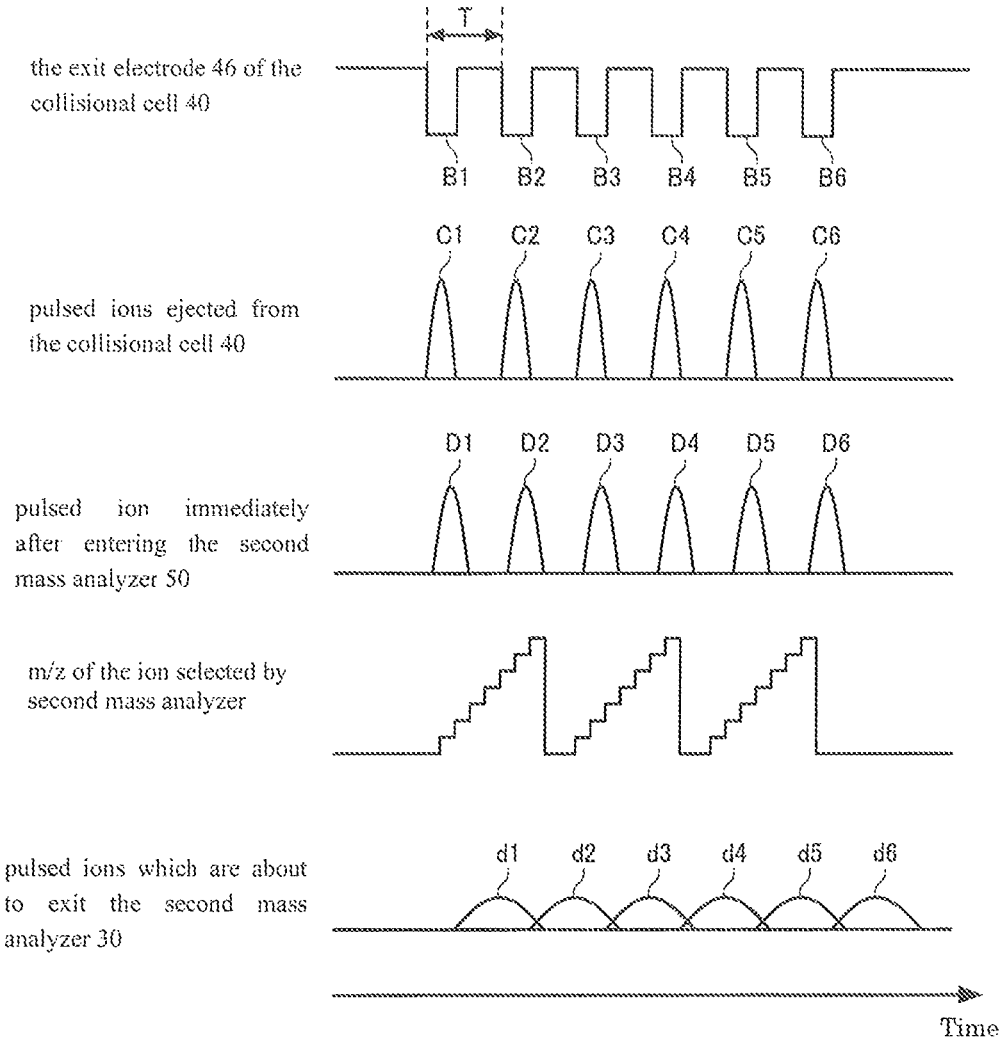
FIG. 2 is a timing chart illustrating one example of sequence of operations performed by the mass spectrometer shown in FIG. 1.

FIG. 2 is a timing chart illustrating one example of sequence of operations performed by the mass spectrometer 1 according to the present embodiment. A pulsed voltage is periodically applied to the exit electrode 46 of the collisional cell 40 with a period T (frequency 1/T). As a result, precursor ions and product ions in the collisional cell 40 are pulsed and periodically delivered from the cell 40.

Specifically, the precursor ions entering the collisional cell 40 fragment in the cell 40 and then are ejected as pulsed ions C1, C2, C3, and so forth by means of ejecting operations B1, B2, B3, and so forth of the exit electrode 46.

The time interval between the pulsed ions C1, C2, C3, and so forth is substantially equal to the opening time of the exit electrode 46 immediately after ejection. As the pulsed ions travel through the second mass analyzer 50, the time interval increases due to nonuniformity in ion velocity. In the present embodiment, the durations of the pulsed ions C1, C2, C3, and so forth are controlled using the interval at which the exit electrode 46 is opened and closed. As the interval decreases, these pulsed ions overlap each other temporally to a greater extent. Also, as the interval decreases, these pulsed ions overlap each other temporally on the more upstream side of the second mass analyzer 50.

In the example of FIG. 2, high-speed scanning is being done by the second mass analyzer 50. The ion selected by the second mass analyzer 50 is varied in turn while the pulsed ions C1, C2, C3, and so forth are passing through the second mass analyzer 50. It is assumed that the pulsed ions C1, C2, C3, and so forth become pulsed ions D1, D2, D3, and so forth, respectively, immediately after entering the second mass analyzer 50 and become pulsed ions d1, d2, d3, and so forth, respectively, immediately prior to leaving the second mass analyzer. For the sake of simplicity of explanation, it is assumed in the example of FIG. 2 that the pulsed ions C1, C2, C3, and so forth contain product ions of various mass-to-charge ratios uniformly.

Adjacent ones of the pulsed ions D1, D2, D3, and so forth which have just entered the second mass analyzer 50 do not overlap each other. Because of nonuniformity in ion velocity, the pulse width is spread. As a result, adjacent ones of the pulsed ions d1, d2, d3, and so forth which are about to exit the second mass analyzer 50 overlap each other.

Figure 3:
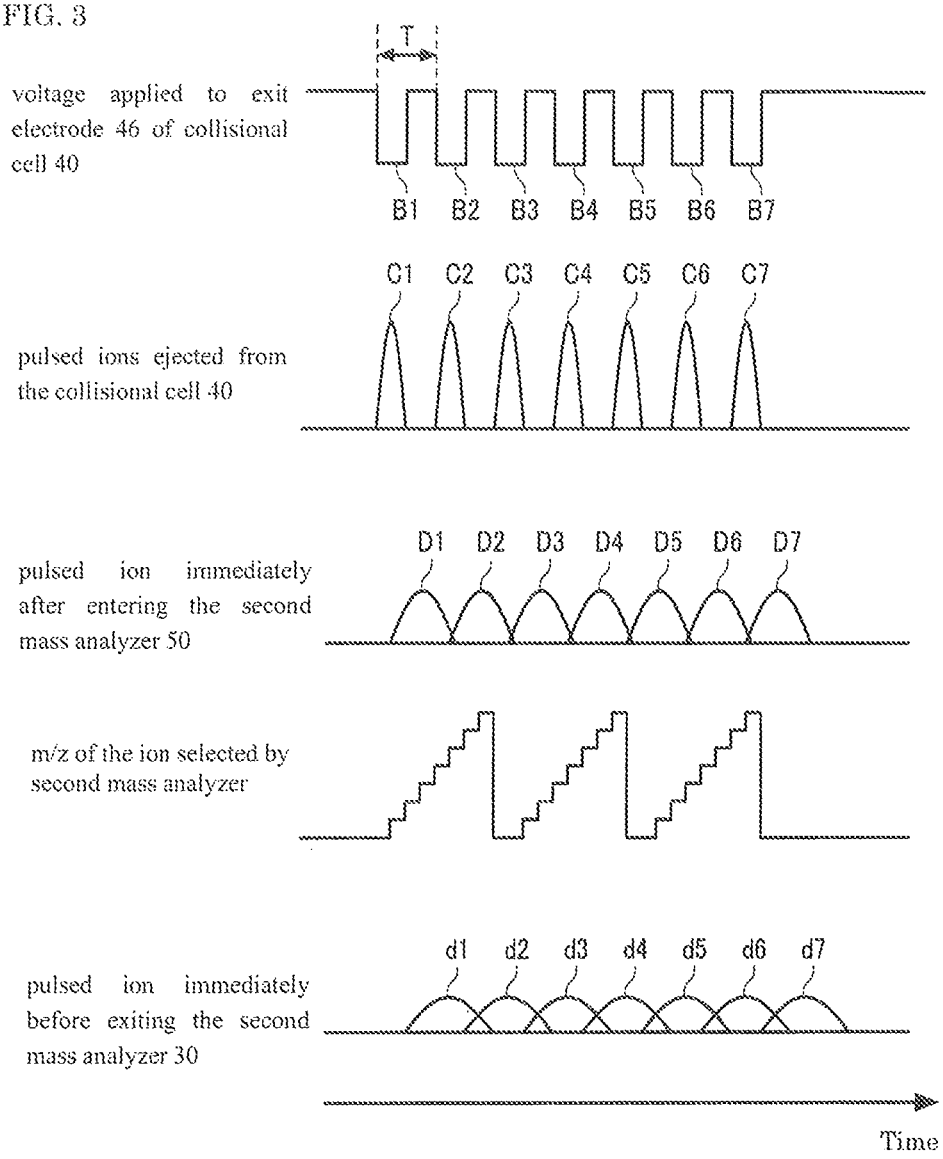
FIG. 3 is a timing chart illustrating another example of sequence of operations performed by the mass spectrometer shown in FIG. 1.

FIG. 3 is a timing chart showing another example of sequence of operations performed by the mass spectrometer 1. In this example, the interval T at which the exit electrode 46 of the collisional cell 40 is opened and closed is made shorter (i.e., the frequency 1/T at which the exit electrode is opened and closed is made higher) than in the example of FIG. 2. In the example of FIG. 3, the tails of the pulsed ions d1, d2, d3, and so forth overlap each other to a greater extent than in the example of FIG. 2. Furthermore, it is seen that the pulsed ions D1, D2, D3, and so forth which have just entered the second mass analyzer 50 overlap each other.

If the interval at which the exit electrode 46 is opened and closed is further reduced, the pulsed ions D1, D2, D3, and so forth are further flattened. As a result, the amount of ions entering the second mass analyzer 50 can be almost prevented from varying temporally. In order to perform high-speed scanning by the second mass analyzer 50, it is most ideal that an ion stream having no temporal variations in this way enters the second mass analyzer.

However, if the interval at which the exit electrode 46 is opened and closed is shortened, ions are stored for a shorter time. Generally, the fragmentation efficiency of the collisional cell 40 worsens. The fragmentation efficiency will not deteriorate unless the storage time is made shorter than a certain value because the ion fragmentation efficiency saturates at or higher than this certain value of storage time. Furthermore, decreases in fragmentation efficiency can be suppressed by increasing the amount of introduced gas. In the present embodiment, ions are temporarily stored in the collisional cell 40 and, therefore, the amount of introduced collision gas is fewer than in the case where a collisional cell having the same dimensions as the collisional cell 40 is used and ions are fragmented without storing them.

As described so far, according to the mass spectrometer of the first embodiment, pulsed ions are smoothed while passing through the second mass analyzer 50 by controlling the interval at which the exit electrode 46 is opened and closed. Therefore, if high-speed scanning where ions selected by the second mass analyzer 50 vary during passage of the ions is performed, a mass spectrum close to a mass spectrum representing intrinsic properties of the sample well can be obtained. If the frequency at which the exit electrode 46 is opened and closed is increased and pulsed ions are smoothed sufficiently, a mass spectrum quite close to the mass spectrum representing intrinsic properties of the sample well is obtained. Furthermore, ions are stored for some time by the collisional cell 40. This allows for miniaturization of the instrument.

2. Second Embodiment

(1) Configuration

The configuration of a mass spectrometer according to a second embodiment of the present invention is described. This instrument is a triple quadrupole mass spectrometer that is configurally different from the mass spectrometer of the first embodiment. One example of the configuration is shown in FIG. 4, which is a schematic cross section of the mass spectrometer of this second embodiment, taken in the vertical direction.

Figure 4:
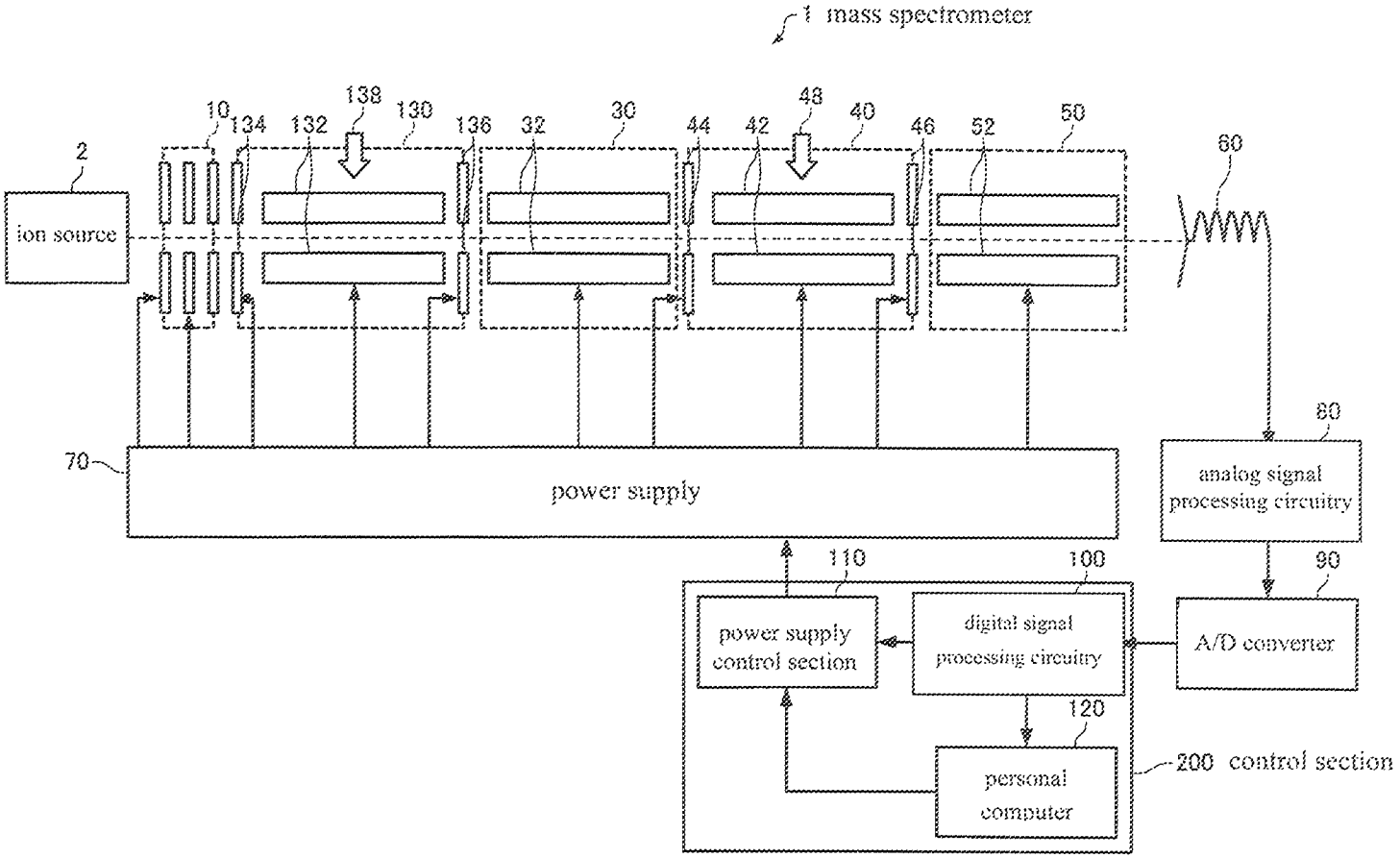
FIG. 4 is a block diagram of a mass spectrometer according to a second embodiment of the present invention.

Referring to FIG. 4, the mass spectrometer according to the second embodiment is generally indicated by reference numeral 1 and configured including an ion source 2, an ion extractor 10, a cooling chamber 130, a first mass analyzer 30, a collisional cell 40, a second mass analyzer 50, a detector 60, a power supply 70, analog signal processing circuitry 80, an A/D converter 90, digital signal processing circuitry 100, a power supply controller 110, and a personal computer 120. Some of the components of the mass spectrometer shown in FIG. 4 may be omitted. The components of FIG. 4 which are the same as their respective counterparts of the instrument shown in FIG. 1 are indicated by the same reference numerals as in FIG. 1 and a description thereof is omitted or simplified.

The difference of the mass spectrometer 1 of the second embodiment with the mass spectrometer of the first embodiment is that the cooling chamber 130 is mounted between the ion extractor 10 and the first mass analyzer 30 instead of the multipole ion guide 22, entrance electrode 24, and exit electrode 26. The cooling chamber 130 includes an ion guide 132, as well as an entrance electrode 134 and an exit electrode 136 located at the opposite ends of the ion guide. According to the need, a gas inlet means 138 (such as a needle valve) for introducing a gas from the outside may be mounted in the cooling chamber 130.

In other respects, the second embodiment is similar to the first embodiment and so a description thereof is omitted.

(2) Operation

The operation of the mass spectrometer 1 according to the second embodiment is next described. In the following description, it is assumed that ions generated in the ion source 2 are positive ions. They may also be negative ions. An explanation similar to the following explanation can be applied to negative ions if the voltages are reversed in polarity. In the following description, regarding the contents which are common with the first embodiment, a description thereof is omitted.

Ions generated in the ion source 2 pass through the ion extractor 10 and enter the cooling chamber 130. Almost all the ions generated in the ion source 2 can be introduced into the cooling chamber 130 by keeping open the entrance electrode 134 of the cooling chamber 130.

In the present embodiment, ions are once stored in the cooling chamber 130 and then ejected. Cooling is done while ions are reciprocating between the entrance electrode 134 and the exit electrode 136 and so the cooling chamber can be reduced in size. Cooling is carried out by repeated collisions of the ions with the collision gas within the cooling chamber. When an atmospheric pressure ion source is used as the ion source 2, air flows in through the entrance electrode 134 together with ions. Collision with the residual gas cools the ions. On the other hand, where the ion source 2 employs an ionization method employed in a vacuum such as an electron impact ionization method, almost no residual gas flows into the cooling chamber 130 and, therefore, the collision gas is introduced by the gas inlet means 138, thus promoting cooling of the ions.

A pulsed voltage is applied to the exit electrode 136 to store ions in the cooling chamber 130. If the pulsed voltage is made higher than the axial voltage on the ion guide 132, the exit electrode 136 is closed and ions are stored in the cooling chamber 130. On the other hand, if the pulsed voltage is made lower than the axial voltage on the ion guide 132, the exit electrode 136 is opened, thus ejecting the ions. The cooling makes lower the energy of ions returning to the entrance electrode 134 after being bounced back by the potential barrier of the exit electrode 136 during storage than the energy of the ions which first passed through the entrance electrode 134. Ions from the upstream side can be made to pass and ions returning from the downstream side can be blocked by adjusting the voltage on the entrance electrode 134. Consequently, the cooling chamber 130 can provide high storage efficiency.

The cooling chamber 130 produces only cooling without fragmenting ions. The final total energy of the ions decreases nearly to the level of the positional energy produced by the axial voltage on the ion guide 132 by the cooling. Therefore, no ion fragmentation occurs if the difference between the total energy of ions just passed through the entrance electrode 134 and the positional energy produced by the axial voltage on the ion guide 132 is not greater than the dissociation energy.

Since ions are stored in and ejected from the cooling chamber 130, the ions are pulsed and enter the first mass analyzer 30. Precursor ions selected by the first mass analyzer 30 enter the collisional cell 40. In the present embodiment, the entrance electrode 44 and the exit electrode 46 of the collisional cell 40 are kept open. Some or all of the precursor ions fragment while passing through the collisional cell 40. The ions selected by the second mass analyzer 50 enter the detector 60.

In the present embodiment, pulsed ions ejected from the cooling chamber 130 pass through the first mass analyzer 30. The produced individual pulsed ions are not completely separated from each other temporally. Two pulsed ions generated by two successive ejecting operations are at least partially overlapped temporally and pass through the first mass analyzer 30. Such temporal smoothing of these pulsed ions permits high-speed scanning at the first mass analyzer 30.

The smoothing is achieved, for example, by reducing the interval at which the exit electrode 136 is opened and closed such that ions are ejected at shorter intervals. Under this condition, because of nonuniformity in ion velocity, the pulsed ions are not completely separated from each other temporally at the first mass analyzer 30.

Figure 5:
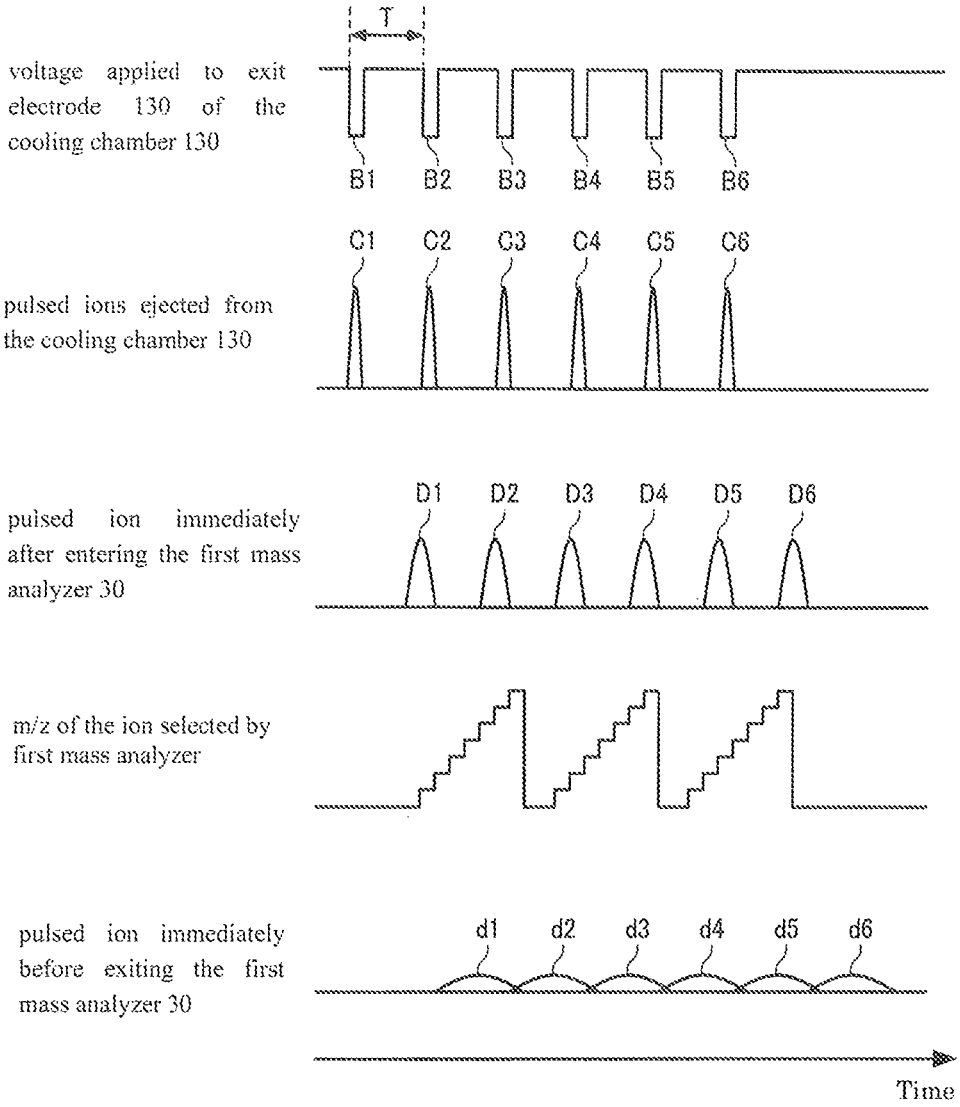
FIG. 5 is a timing chart illustrating one example of sequence of operations performed by the mass spectrometer shown in FIG. 4.

FIG. 5 is a timing chart which illustrates one example of sequence of operations performed by the mass spectrometer 1 of the present embodiment and which corresponds to the timing chart of FIG. 2 illustrating the first embodiment. As shown in FIG. 5, a pulsed voltage is periodically applied to the exit electrode 136 of the cooling chamber 130 with a period T (frequency 1/T), so that ions generated in the ion source 2 are pulsed and ejected periodically from the cooling chamber 130.

Specifically, the ions generated in the ion source 2 are stored in the cooling chamber 130 and then ejected as pulsed ions C1, C2, C3, and so forth from the cooling chamber 130 by means of ejecting operations B1, B2, B3, and so forth of the exit electrode 136.

The pulsed ions C1, C2, C3, and so forth ejected from the cooling chamber 130 enter the first mass analyzer 30. Pulsed precursor ions selected by the first mass analyzer 30 are periodically introduced into the collisional cell 40.

In the example of FIG. 5, the first mass analyzer 30 is performing scanning at high speed. The ion selected by the first mass analyzer 30 is varied in turn while the pulsed ions C1, C2, C3, and so forth are passing through the analyzer 30. It is assumed that the pulsed ions C1, C2, C3, and so forth become pulsed ions D1, D2, D3, and so on, respectively, immediately after entering the first mass analyzer 30 and become pulsed ions d1, d2, d3, and so on, respectively, immediately before departing from the first mass analyzer 30. For the sake of simplicity, in the example of FIG. 5, it is assumed that ions of various mass-to-charge ratios are uniformly contained in the pulsed ions C1, C2, C3, and so forth.

The pulsed ions D1, D2, D3, and so on which have just entered the first mass analyzer 30 do not overlap with adjacent pulsed ions. As a result of spreading of pulse widths of the ions due to variations in ion velocity, the pulsed ions d1, d2, d3, and so on which are about to exit the first mass analyzer 30 are seen to overlap with adjacent pulsed ions.

Figure 6:
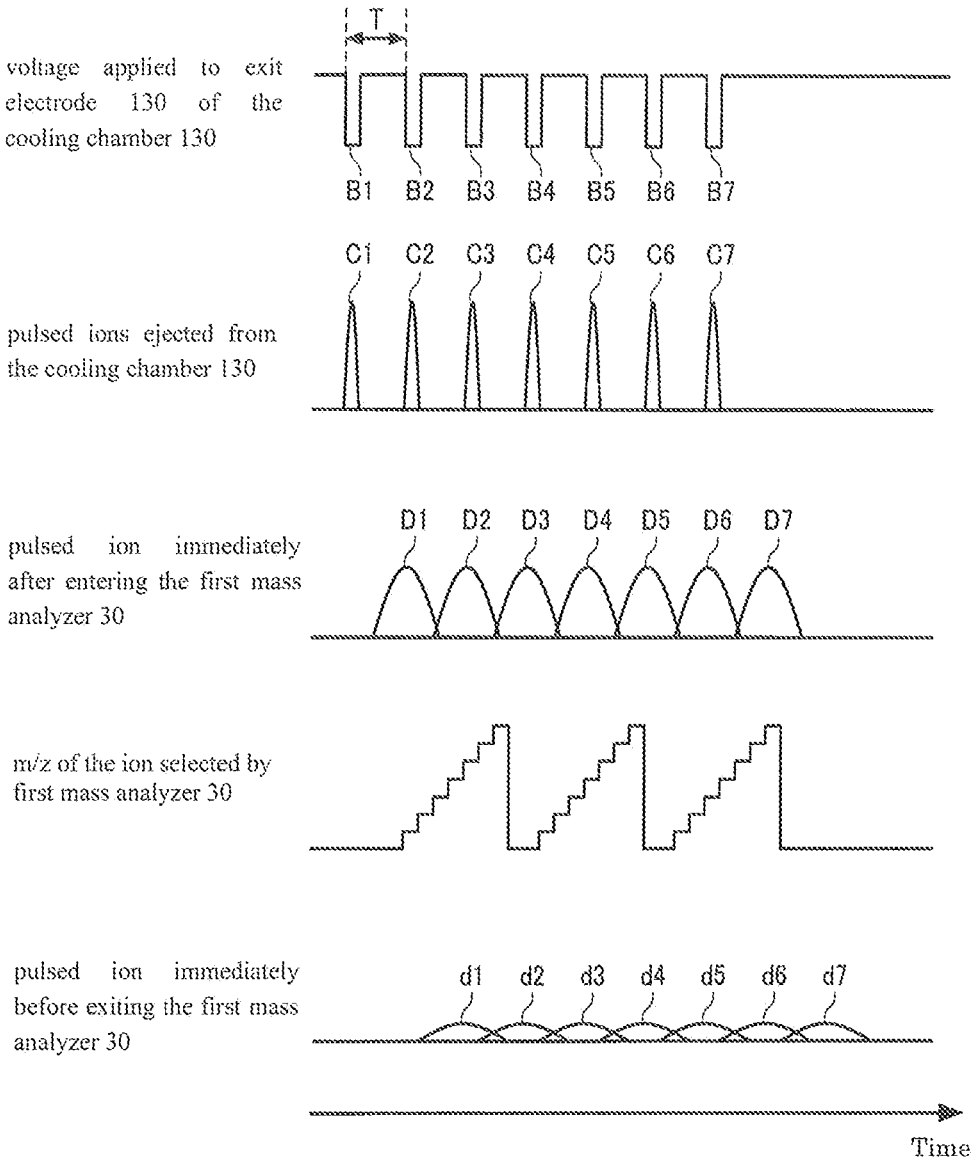
FIG. 6 is a timing chart illustrating another example of sequence of operations performed by the mass spectrometer shown in FIG. 4.

FIG. 6 is a timing chart which illustrates another example of sequence of operations performed by the mass spectrometer 1 and which corresponds to the timing chart of FIG. 3 illustrating the first embodiment. In the example of FIG. 6, the interval T at which the exit electrode 136 of the cooling chamber 130 is opened and closed is made shorter (the frequency 1/T is made higher) than in the example of FIG. 5. In the example of FIG. 6, the tails of the pulsed ions d1, d2, d3, and so forth overlap each other to a greater extent than in the example of FIG. 5. Furthermore, it is seen that the pulsed ions D1, D2, D3, and so forth which have just entered the first mass analyzer 30 overlap each other.

If the interval at which the exit electrode 136 is opened and closed is shortened further, the pulsed ions D1, D2, D3, and so forth are smoothed further. As a result, the amount of ions entering the first mass analyzer 30 varies little temporally. In order to perform scanning at high speed by the first mass analyzer 30, it is most ideal to pass an ion stream that does not vary temporally in this way into the analyzer 30.

However, if the interval at which the exit electrode 136 is opened and closed is shortened, the kinetic energies of the ions do not drop sufficiently. Generally, the resolution of the first mass analyzer 30 is not improved. If the storage time is equal to or longer than a certain value, the kinetic energies of ions decrease to a certain value. Therefore, if the storage time is made longer than this value, the resolution of the first mass analyzer 30 can be improved. The kinetic energies of ions can be lowered sufficiently by increasing the amount of introduced gas. In the present embodiment, ions are temporarily stored in the cooling chamber 130 and so the required amount of introduced collision gas can be made smaller than where ions are fragmented using a cooling chamber having the same dimensions as the cooling chamber 130 without storing ions.

As described so far, in the mass spectrometer according to the second embodiment, pulsed ions are smoothed while passing through the first mass analyzer 30 by controlling the interval at which the exit electrode 136 is opened and closed. Therefore, if high-speed scanning where the ion selected by the first mass analyzer 30 varies during passage through the first mass analyzer is performed, a mass spectrum close to a mass spectrum representing intrinsic properties of the sample well can be obtained. If the interval at which the exit electrode 136 is opened and closed is shortened to smooth pulsed ions sufficiently, a mass spectrum substantially identical with the mass spectrum representing intrinsic properties of the sample well can be derived. Furthermore, miniaturization of the instrument can be accomplished, because ions are stored for a given time in the cooling chamber 130.

3. Third Embodiment

(1) Configuration

The configuration of a mass spectrometer according to a third embodiment of the present invention is described. This spectrometer is a single quadrupole mass spectrometer and similar to the mass spectrometer of the second embodiment except that the collisional cell 40 and the second mass analyzer 50 are removed. One example of the configuration of the mass spectrometer of the third embodiment is shown in FIG. 7, which is a schematic cross section of the mass spectrometer, taken in the vertical direction.

Figure 7:
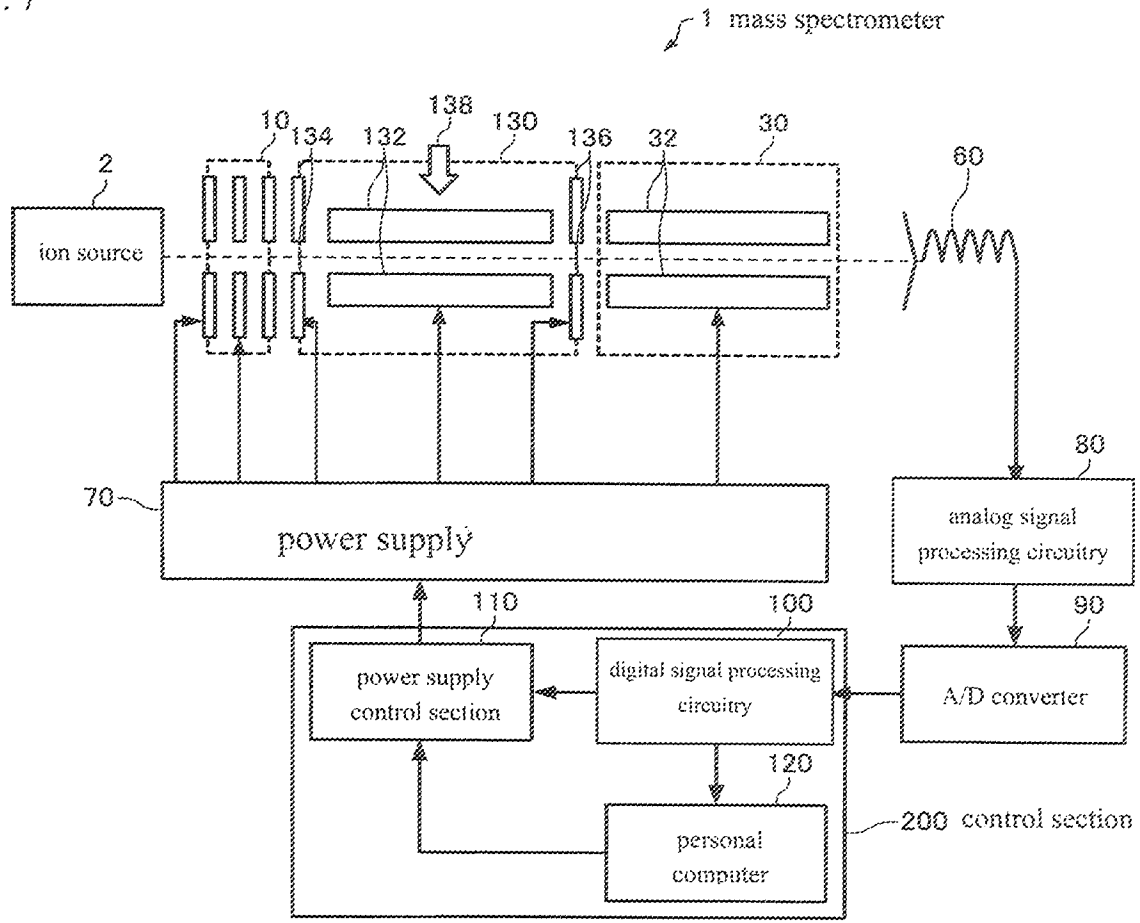
FIG. 7 is a block diagram of a mass spectrometer according to a third embodiment of the present invention.

As shown in FIG. 7, a mass spectrometer, indicated by reference numeral 1, according to the third embodiment of the present invention is configured including an ion source 2, an ion extractor 10, a cooling chamber 130, a mass analyzer 30, a detector 60, a power supply 70, analog signal processing circuitry 80, an A/D converter 90, digital signal processing circuitry 100, a power supply controller 110, and a personal computer 120. Some components of the mass spectrometer of this embodiment shown in FIG. 7 may be omitted. Those components of FIG. 7 which are identical with their respective counterparts of FIG. 1 or 4 are indicated by the same reference numerals as in FIG. 1 or 4 and a description thereof is omitted or simplified.

The ions generated in the ion source 2 pass through the ion extractor 10 and are cooled by the cooling chamber 130. Then, desired ions are selected by the mass analyzer 30 and detected by the detector 60. A signal indicative of the detected ions is converted into a voltage by the analog signal processing circuitry 80 and undesired noises are removed. Finally, the signal is sampled by the A/D converter 90.

In other respects, the third embodiment is similar to the first or second embodiment and so a description thereof is omitted.

(2) Operation

The operation of the mass spectrometer 1 according to the third embodiment is next described. In the following description, it is assumed that ions generated in the ion source 2 are positive ions. They may also be negative ions. An explanation similar to the following explanation can be applied to negative ions if the voltages are reversed in polarity. In the following description, those parts which are common with the contents of the first or second embodiment are omitted.

In the present embodiment, ions are cooled by the cooling chamber 130 without fragmenting the ions in the same way as in the second embodiment. Since ions are stored in the cooling chamber 130, the ions are cooled while reciprocating between the entrance electrode 134 and the exit electrode 136. Consequently, the cooling chamber can be reduced in size.

Ions generated in the ion source 2 pass through the ion extractor 10 and enter the cooling chamber 130. In the present embodiment, ions are once stored in the cooling chamber 130 and then ejected by applying a pulsed voltage to the exit electrode 136 in the same way as in the second embodiment.

Since ions are stored in and ejected from the cooling chamber 130, the ions are pulsed and enter the mass analyzer 30. Desired ions selected by the mass analyzer 30 enter the detector 60.

In the present embodiment, pulsed ions ejected from the cooling chamber 130 pass through the mass analyzer 30 but produced individual pulsed ions are not completely separated from each other temporally. Two pulsed ions generated by two successive ejecting operations are at least partially overlapped temporally and pass through the mass analyzer 30. Such temporal smoothing of the pulsed ions permits high-speed scanning at the mass analyzer 30.

The smoothing is achieved, for example, by reducing the interval at which the exit electrode 136 is opened and closed such that ions are ejected at shorter intervals of time. As a result, pulsed ions are not completely separated from each other temporally at the mass analyzer 30 due to variations in ion velocity.

Figure 8:
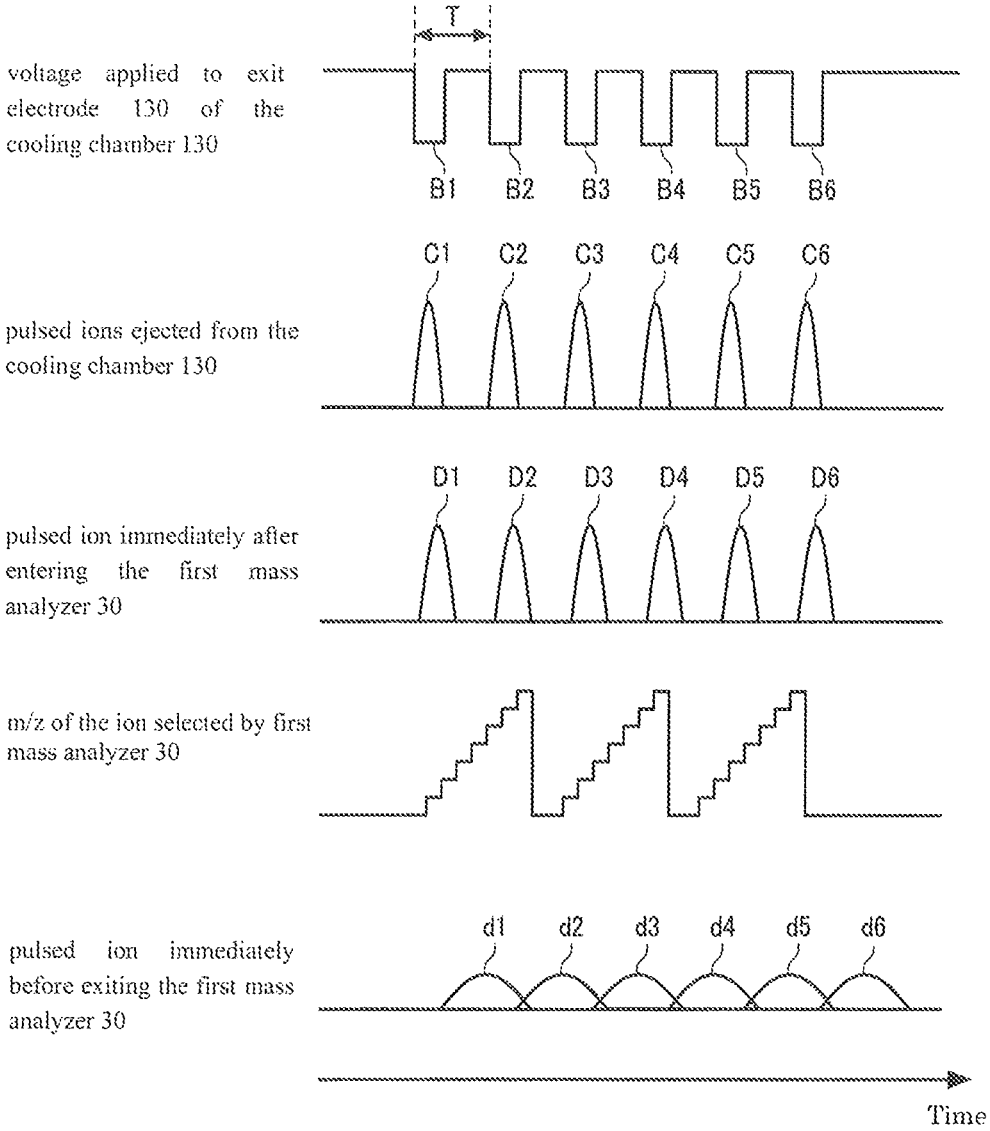
FIG. 8 is a timing chart illustrating one example of sequence of operations performed by the mass spectrometer shown in FIG. 7.

FIG. 8 is a timing chart which illustrates one example of sequence of operations performed by the mass spectrometer 1 according to the present embodiment and which corresponds to the timing charts of FIGS. 2 and 5 illustrating the first and second embodiments, respectively. As shown in FIG. 8, a pulsed voltage is periodically applied to the exit electrode 136 of the cooling chamber 130 with a period T (frequency 1/T). Ions generated in the ion source 2 are pulsed and periodically ejected from the cooling chamber 130.

In particular, the ions generated in the ion source 2 are stored in the cooling chamber 130, become pulsed ions C1, C2, C3, and so on by means of ejecting operations B1, B2, B3, and so on of the exit electrode 136, and are ejected from the cooling chamber 130. The pulsed ions C1, C2, C3, and so on ejected from the cooling chamber 130 enter the mass analyzer 30.

In the example of FIG. 8, high-speed scanning is performed by the mass analyzer 30. The ion selected by the mass analyzer 30 is varied in turn while the pulsed ions C1, C2, C3, and so on are passing through the mass analyzer 30. It is assumed that the pulsed ions C1, C2, C3, and so on become pulsed ions D1, D2, D3, and so on, respectively, immediately after entering the mass analyzer 30 and that they become pulsed ions d1, d2, d3, and so on, respectively, immediately before exiting the mass analyzer. For the sake of simplicity of explanation, in the example of FIG. 8, it is assumed that ions of various mass-to-charge ratios are uniformly contained in the pulsed ions C1, C2, C3, and so on.

The pulsed ions D1, D2, D3, and so on which have just entered the mass analyzer 30 do not overlap with adjacent pulsed ions. However, their pulse width is spread due to variations in ion velocity. Consequently, the pulsed ions d1, d2, d3, and so on which are about to exit the mass analyzer 30 are seen to overlap with adjacent pulsed ions.

Figure 9:
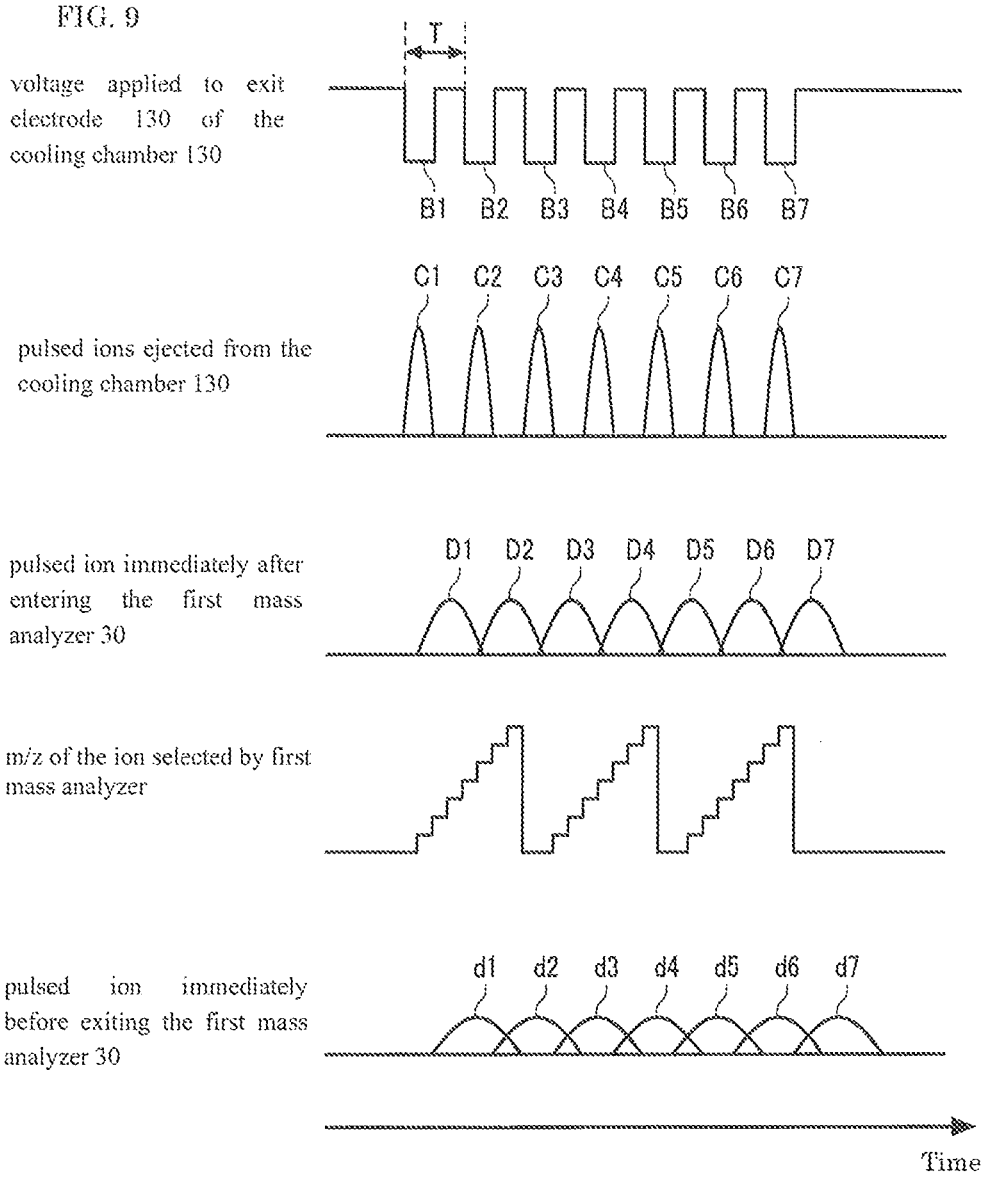
FIG. 9 is a timing chart illustrating another example of sequence of operations performed by the mass spectrometer shown in FIG. 7.

FIG. 9 is a timing chart which illustrates one example of sequence of operations of the mass spectrometer 1 and which corresponds to the timing charts of FIGS. 3 and 6 illustrating the first and second embodiments, respectively. In the example of FIG. 9, the period T with which the exit electrode 136 of the cooling chamber 130 is opened and closed is shorter (the frequency 1/T at which the exit electrode is opened and closed is higher) and tails of the pulsed ions d1, d2, d3, and so on overlap each other to a greater extent than in the example of FIG. 8. Furthermore, it is observed that the pulsed ions D1, D2, D3, and so on which have just entered the mass analyzer 30 overlap each other.

If the interval at which the exit electrode 136 is opened and closed is reduced further, the pulsed ions D1, D2, D3, and so on are smoothed further. Timewise variations in the amount of ions entering the mass analyzer 30 can be eliminated almost totally. In order to perform scanning at high speed at the mass analyzer 30, it is most ideal that an ion stream free of timewise variations in this way enters the mass analyzer 30.

However, if the interval at which the exit electrode 136 is opened and closed is shortened, the kinetic energies of the ions do not drop sufficiently. Generally, the resolution of the mass analyzer 30 is not improved. If the storage time is equal to or longer than a certain value, the kinetic energies of ions decrease to a certain value. Therefore, if the storage time is made longer than this value, the resolution of the mass analyzer 30 can be improved. The kinetic energies of ions can be lowered sufficiently by increasing the amount of introduced gas. In the present embodiment, ions are temporarily stored in the cooling chamber 130 and so the required amount of introduced collision gas can be made smaller than where ions are fragmented using a cooling chamber having the same dimensions as the cooling chamber 130 without storing ions.

As described so far, in the mass spectrometer according to the third embodiment, pulsed ions are smoothed while traveling through the mass analyzer 30 by controlling the interval at which the exit electrode 136 is opened and closed. Therefore, if high-speed scanning where the ion selected by the mass analyzer 30 changes while passing through the mass analyzer 30 is done, a mass spectrum close to a mass spectrum representing intrinsic properties of the sample well can be obtained. If the interval at which the exit electrode 136 is opened and closed is shortened to smooth pulsed ions sufficiently, a mass spectrum substantially identical to the mass spectrum representing intrinsic properties of the sample well is obtained. Since ions are stored for a given time in the cooling chamber 130, it is also possible to allow for miniaturization of the instrument.

4. Modifications

The present invention is not restricted to the embodiments described so far but rather various modifications can be made thereto within the scope of the present invention.

Modification 1

In the above embodiments, a pulsed voltage is applied to the exit electrode 46 of the collisional cell 40 or to the exit electrode 136 of the cooling chamber 130. The applied voltage is not restricted to a pulsed voltage. Any voltage that permits storage and ejection of ions may also be applied. That is, in the first embodiment, the voltage applied to the exit electrode 46 of the collisional cell 40 may vary up and down about the axial voltage on the multipole ion guide 42. In the second or third embodiment, the voltage applied to the exit electrode 136 of the cooling chamber 130 may vary up and down about the axial voltage on the ion guide 132. If this requirement is satisfied, a voltage varying like a sinusoidal wave or triangular wave may also be used.

Modification 2

In the above embodiments, the tails of pulsed ions are made to overlap each other while ejected pulsed ions are passing through a downstream mass analyzer. The tails of pulsed ions may be made to overlap each other before being sampled by the A/D converter 90.

For example, the frequency of the pulsed voltage applied to the exit electrode 46 or 136 is set higher than the frequency bandwidth of the analog signal processing circuitry 80. Conversely, the frequency bandwidth of the analog signal processing circuitry 80 is set lower than the frequency of the pulsed voltage. Consequently, two pulsed ions which are separate on entering the detector 60 in turn may be smoothed temporally by the analog signal processing circuitry 80.

It is to be noted that the above-described embodiments and modifications are merely exemplary and that the present invention is not restricted thereto. For instance, the embodiments and modifications may be appropriately combined.

The present invention embraces configurations (e.g., configurations identical in function, method, and results or identical in purpose and advantageous effects) which are substantially identical to the configurations described in any one of the above embodiments. Furthermore, the invention embraces configurations which are similar to the configurations described in any one of the above embodiments except that their nonessential portions have been replaced. Additionally, the invention embraces configurations which are identical in advantageous effects to, or which can achieve the same object as, the configurations described in any one of the above embodiments. Further, the invention embraces configurations which are similar to the configurations described in any one of the above embodiments except that a well-known technique is added.

Having thus described my invention with the detail and particularity required by the Patent Laws, what is desired protected by Letters Patent is set forth in the following claims:

1. A mass spectrometer comprising:

an ion source for ionizing a sample;

an ion storage-and-ejection cell having an entrance electrode and exit electrode which performs a storing operation to store at least some of the ions generated by the ion source introduced in the cell through the entrance electrode and performs an ejecting operation to eject the stored ions in pulses through the exit electrode repeatedly opened and closed by signals applied to the exit electrode;

a scanning quadrupole mass analyzer to receive said ion pulses from the ion storage-and-ejection cell and to pass through only the ions having the mass-to-charge ratio specified by a mass-selective signal;

a detector for detecting the ions passed through the scanning quadrupole mass analyzer;

analog signal processing circuitry for converting a signal from the detector into a voltage;

an A/D converter for sampling and converting the output voltage from the analog signal processing circuitry into a digital signal; and a computer for generating the pulse signals to be supplied to the exit electrode and for repeatedly generating a scanning mass-selective signal to scan the mass-to-charge ratio of the ions passed through the quadrupole mass analyzer, wherein said computer controls the frequency of the exit electrode pulse signals such that the ejected ion pulses from the storage-and-ejection cell are at least partially overlapped before exiting the scanning quadrupole mass analyzer and while the at least overlapped pulses are passing through the scanning quadrupole analyzer.

2. The mass spectrometer as set forth in claim 1, wherein said computer causes the storage-and-ejection portion to perform said storing operation and said ejecting operation by applying a voltage varying like a rectangular, sinusoidal, or triangular wave to an exit electrode of the ion storage-and-ejection cell.

3. The mass spectrometer as set forth in claim 1, wherein said ion storage and ejection cell is a cooling chamber arranged downstream from the ion source and receiving ions from the ion source for lowering kinetic energies of the ions generated in said ion source.

4. The mass spectrometer as set forth in claim 1, wherein there are further provided an additional mass analyzer for selecting first desired ions according to mass-to-charge ratio from the ions generated in said ion source, wherein said ion storage and ejection cell is a collisional cell receiving first desired ions from said additional mass analyzer for fragmenting some or all of the first desired ions into product ions.

5. A method of controlling a mass spectrometer having: an ion source for ionizing a sample; an ion storage-and-ejection cell for performing a storing operation for storing at least some of the ions generated in the ion source and then performing an ejecting operation for ejecting the stored ions; a scanning quadrupole mass analyzer for selecting desired ions according to mass-to-charge ratio from the ions ejected from the ion storage-and-ejection cell; a detector for detecting the desired ions; analog signal processing circuitry for converting a signal from the detector into a voltage; and an A/D converter for sampling and converting the output voltage from the analog signal processing circuitry into a digital signal, said method comprising the step of:

controlling timings of storage and ejection frequency of ions performed by the ion storage-and-ejection cell delivering ion pulses to the scanning quadrupole mass analyzer such that the ejected ion pulses travel through the quadrupole mass analyzer at least partially overlapped; and while the at least partially overlapped pulses are passing through the scanning quadrupole mass analyzer repeatedly scanning the quadrupole mass analyzer.

* * * * *